US005110999A

United States Patent [19]

Barbera

[11] Patent Number: 5,110,999

[45] Date of Patent: May 5, 1992

[54] AUDIOPHILE CABLE TRANSFERRING POWER SUBSTANTIALLY FREE FROM PHASE DELAYS

[76] Inventor: Todd Barbera, 116 Front St., Marblehead, Mass. 01945

[21] Appl. No.: 622,003

[22] Filed: Dec. 4, 1990

[51] Int. Cl.[5] ..... H01B 7/34

[52] U.S. Cl. ..... 174/36; 174/113 C; 174/115; 174/116; 174/107

[58] Field of Search ..... 174/36, 115, 116, 113 C, 174/131 A, 107

[56] References Cited

U.S. PATENT DOCUMENTS

| | | | |
|---|---|---|---|
| 2,286,826 | 6/1942 | Morrison . | |
| 3,261,907 | 7/1966 | Morrison | 174/115 |
| 3,355,544 | 11/1967 | Costley et al. | 174/106 R |
| 3,594,491 | 7/1971 | Zeidlhack | 174/36 |
| 3,602,632 | 9/1971 | Ollis | 174/36 |
| 3,603,718 | 9/1971 | Godenk | 174/47 |
| 3,699,238 | 10/1972 | Hansen et al. | 174/115 |
| 3,815,054 | 6/1974 | McClure et al. | 333/5 |
| 3,829,603 | 8/1974 | Hansen et al. | 174/115 |
| 3,843,831 | 10/1974 | Hutchison et al. | 174/116 |
| 3,993,860 | 11/1976 | Snow et al. | 174/69 |
| 4,301,428 | 11/1981 | Mayer | 333/12 |
| 4,315,099 | 2/1982 | Gerardot et al. | 174/47 |
| 4,617,449 | 10/1986 | Weitzel et al. | 219/301 |
| 4,677,256 | 6/1987 | Bauer et al. | 174/131 A X |
| 4,712,067 | 12/1987 | Roschmann et al. | 324/318 |
| 4,719,414 | 1/1988 | Miller et al. | 324/95 |
| 4,734,544 | 3/1988 | Lee | 174/131 A X |
| 4,767,890 | 8/1988 | Magnan | 174/28 |
| 4,769,656 | 9/1988 | Dickey | 343/718 |
| 4,777,324 | 10/1988 | Lee | 174/34 |
| 4,804,917 | 2/1989 | Miller et al. | 324/95 |
| 4,808,773 | 2/1989 | Crandall | 174/113 R |

FOREIGN PATENT DOCUMENTS

| | | | |
|---|---|---|---|
| 937851 | 9/1963 | United Kingdom | 174/36 |

OTHER PUBLICATIONS

Signet ©, *Audio and Video Cables for Maximum Transfer*, Form No. 409, Stow, Ohio (1986)—Brochure.

Zapchord, *Speaker Cable from Music Interface Technologies*, Hollis, Me., Audio Magazine (Aug. 1989)—Advertisement.

*Primary Examiner*—Morris H. Nimmo

*Attorney, Agent, or Firm*—Weingarten, Schurgin, Gagnebin & Hayes

[57] ABSTRACT

The invention provides a compact, circular, flexible, and shielded twin-axial, multi-stranded power cable for transferring current instantaneously and with uniform density substantially free from phase delays at 60 Hz. between a high current power amplifier and a standard three-hole 112 volt AC outlet achieving a pure and powerful bass response and clear, brilliant noise-free highs. The cable has two bundles of five insulated conductors helically and symmetrically wrapped around a dielectric center. The gauge of each conductor and total cross-sectional area of the bundled conductors are predetermined to avoid internal inductance and phase delay effects while providing high current instantaneously and uniformly in high-end audio power applications. In between the bundles are located ground wires which run the length of the cable. The bundles and ground wires are spirally twisted around each other for structural integrity and for a generally round cross-sectional shape. A thin polypropylene filler surrounds this spiral twist. A non-insulated drain wire and an aluminum foil shield are wrapped around the filler. A flexible cable jacket is extruded around the shielded cable. The cable of the present invention unexpectedly renders benefits in high-end audio applications even though it does not operate within the signal path of the system.

13 Claims, 2 Drawing Sheets

AUDIOPHILE CABLE TRANSFERRING POWER SUBSTANTIALLY FREE FROM PHASE DELAYS

FIELD OF THE INVENTION

This invention relates to the field of electrical cables, and more particularly to a shielded multi-stranded twin-axial power cable for providing high current of uniform density free from phase delays to audio equipment.

BACKGROUND OF THE INVENTION

Cable art has become a major concern to audiophiles. In comparatively recent times, the cable has been considered in itself an integral component of a high quality or so-called "high-end" audio system rather than merely a sonically neutral link between equipment. The present invention relates to a power cable for installation in power supply sections of audio equipment, and it is ideally suited for use with high current power amplifiers.

The cable art has been concerned hitherto with the transmission of electrical signals along the signal path; that is, from source inputs such as phonograph players, tuners, and CD players, to preamplifiers and power amplifiers, and from power amplifiers to loudspeakers. The cables which electrically link audio equipment along the signal path have been referred to as "interconnects". Of primary concern has been the skin effect, whereby signals traveling at the "skin" or farthest radial distance from the center of a conductor induce time shifts in signals traveling near the center of the conductor. U.S. Pat. No. 4,767,890 ("Magnan"), incorporated herein by reference, addresses the so-called "skin effect" problem in interconnect cables, including cables used to connect amplifiers to speakers, which transmit broad-band audio signals. Magnan teaches that when signals at audio frequencies are transmitted through prior art cables comprising a plurality of conductors, the high frequency components propagate along conductors on the outside of the cable and travel at a faster speed than the lower frequency components which propagate along the conductors at the center of the cable and travel at a lower speed. The signals of the various components arrive at and drive the speakers at different times, and result in a "smearing" of the reproduced sound signal.

The Magnan patent discloses the use of a twin-axial pair of cables comprising a number of insulated conductors spiralled helically around a large diameter air core and within a spirally wrapped dielectric tube spacer to approximate a pair of thin conducting cylinders. The preferred embodiment consists of one 84-gauge, three 37-gauge, and three 40-gauge oxygen-free copper conductors and five 26-gauge TFE Teflon tubes, all shielded within a braided shield and a cable jacket. An external, shielded ground return for conducting higher levels of DC is provided outside of the main shielded cable. As will be appreciated by those skilled in the art, the Magnan approach is better than the standard multistranded wire for transmitting broad-band signals. However, the Magnan approach does not teach or indicate how to construct a compact, relatively inexpensive cable for use as a power cable for transmitting high current at 60 Hz at uniform density free from phase delays.

The audiophile industry has not sufficiently focused upon the construction of "audiophile power cables". U.S. Pat. No. 3,261,907, incorporated herein by reference, is a rare example in which the internal inductive effects of current have been considered in the area of power cables, and expressly provides for a cable for high frequency systems, specifically the 400-cycle system used in the power circuits for aircraft and surface ships, but not, however, to the standard 60-cycle system dear to the audiophile. The cable disclosed therein is merely intended to overcome the electrical difficulties presented by high frequency polyphase circuits by using cables with multiple conductors concentrically arranged and interposed with concentric layers of insulation. However, the '907 reference does not disclose or instruct how a power cable is to be used in a standard 60-cycle system which presents its own self-inductance problems when used in high current audiophile applications. Nor does it suggest, because it does not consider, the "esoteric" sonic concerns of audiophiles.

For current of any given frequency travelling along a conductor, a "skin effect" or inductance problem arises whereby current travelling at the outer radial dimensions of a conductor generates a field which electromagnetically inhibits current traveling near the core of the conductor. The effect is such that current arriving at the end of the typical power cable, i.e. lamp cord, attached to the power supply section of a power amplifier suffers from phase delay. This effect is that the current in the center of the wire is less than the amount of current travelling at the outer radial portions of the conductor. While a person of ordinary skill in the art might question the sonic effect to be derived from a cord which lies beyond the signal path and which, moreover, is intended to transfer current at one frequency (60-Hz), there are indeed insignificant sonic problems which the present invention unexpectedly redresses.

High current amplifiers are increasingly being used by audiophiles for their ability to drive high impedance loads, typically loudspeakers presenting 4 ohms or less per stereophonic side, New speaker technologies, such as electrostatic speakers, or planar speakers in which current must be passed through microscopic wires suspended in mylar diaphragms across magnetic fields, frequently present difficult loads for which the ability to transfer high current instantly, uniformly, and continuously is required. Even with loudspeakers employing conventional 8 ohm piston-driven transducers, difficult loads are presented by complex electronic cross-overs, driver arrays, and musical signals which may contain highly complex waveforms extending throughout the broad-band audio spectrum. Moreover, with recent improvements in source components such as CD players and turntables equipped with high output moving coil cartridges, it is desirable to have amplifiers and power supplies provide high amounts of current instantaneously, uniformly, and consistently for accurate and high-resolution reproduction of transient information, even at low listening volumes. The demand for the desired capabilities of transferring high current is even necessary for amplifiers or power supply stages which are regulated and have large filter capacitors, since sudden power drains may occur requiring that a power cable provide surges of current up to 20 amperes instantly without self-induced phase delays or ripple effects in the 60 Hz line.

An "audiophile" power cable is therefore needed in view of the foregoing demands and disadvantages explained above.

SUMMARY OF THE INVENTION

In surmounting the foregoing described disadvantages, the present invention provides a shielded twin-axial power cable which avoids the "skin effect," or inductance problems, which arise where instantaneous and continuously supplied current of uniform density is required for the accurate reproduction of audio signals.

The use of the present invention in combination with so-called "high-end" stereo amplifiers or tandem monaural high current amplifiers, especially those having output capabilities upwards of 200–300 watts per channel rms, provides discernible sonic benefits. Among the benefits are increased definition in the reproduction of signals in the low bass frequencies. For example, the impact of a mallet striking a timpani drum may be heard more sharply, and the timbre does not disappear as readily. The low noise power cable of the invention provides the improved ability to reproduce transients (the so-called profiles and "leading edges" of signal waveforms) accurately, which also facilitates a more credible reproduction of the "three-dimensional sound stage" of certain recordings. In other words, where a recording contains numerous musical instruments, the power cable of the invention contributes to the ability of the equipment to permit a listener more easily to distinguish between instruments and to locate instruments between, forward and rear of loudspeakers positioned for stereophonic listening.

The present invention, in one disclosed embodiment, is comprised of a twin-axial bundle of insulated conductor strands which are helically and symmetrically wrapped around a dielectric center which is approximately of the same or less cross-sectional area than that of the insulated strands. The size of the insulated strands, in order to avoid the skin effect, is determined so that the radius of the strand is no greater than one half the skin depth of AC current travelling at 60 cycles from a standard wall outlet thereby eliminating undesirable phase delays. The number of strands is determined, in order to carry the magnitude of current called for in high-end equipment, to be the minimum required for applications involving a high current stereo amplifier, typically capable of drawing about 20 amperes and providing about 1,000 watts per channel rms into an 8 ohm load. Thus, one embodiment of the invention described herein deploys two bundles each having five insulated 18 AWG wires wrapped around a dielectric center. Along each of the pair of conductor bundles is located a ground wire. In one embodiment of the invention two insulated 18 AWG wires are used for ground wires. The grouped pairs of conductor bundles and ground wires are then again helically twisted uniformly among themselves in spiral fashion. This twisting affords a generally circular shape which permits the cable to flex equally in all directions without sustaining kinks and altering the internal structure and placement of the wires and conductors. A polypropylene filler, which can be used for the center dielectric material of the twin-axial conductor bundles is placed around the twisted grouped pairs. A non-insulated drain wire is added to the surrounding filler, which is electrically contacting a foil shield wrapped thereabout for providing protection against EMI and RFI. The foil shield, the non-insulated drain wire and the ground wires are terminated at both ends of the cable and connected to respective ground points. The shielded cable is covered by a flexible plastic cable jacket.

The cable of the present invention may also be used to connect power supplies of other high end audio components such as preamplifiers, compact disk players, and tuners. The cable, however, is ideally suited for use with power amplifiers of high current capability or line conditioners to which other high-end equipment is connected. The twin-axial cable of the preferred embodiment provides for a flow of current of uniform density substantially free from phase delays which is necessary for transferring high amounts of current consistently and instantaneously to amplifier power supplies which demand high instantaneous current for the accurate reproduction of complex musical passages, such as orchestral and symphonic works having massed strings, brass, or woodwinds. Such a cable also facilitates the transfer of current to the amplifier for the accurate reproduction of waveforms appearing at the extreme ends of the audible frequency spectrum, such as timpani or organ pedals and triangles or cymbals. Such waveforms at the lower and upper ends of the audible frequency spectrum often require ten to twenty times as much power, and hence create greater demands for current than do waveforms appearing in the mid-frequency regions for any given volume level.

DESCRIPTION OF THE DRAWINGS

A more complete understanding of the present invention and the attendant advantages and features thereof will be more readily understood by reference to the following detailed description of the invention when considered in conjunction with the accompanying drawings wherein.

DETAILED DESCRIPTION OF THE INVENTION

Figure 1:
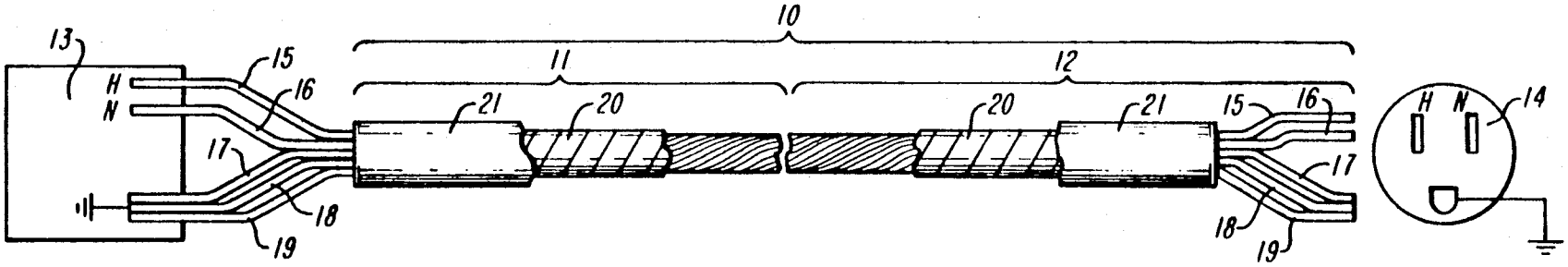
FIG. 1 is a pictorial view of some of the components of one embodiment of a power cable constructed in accord with the present invention showing connection of two conductor bundles, ground wires, and drain wire between a power supply and a standard 112 volt AC outlet typically found in the United States of America.

An exemplary embodiment of the invention is shown in the drawings wherein like numerals denote features as correspondingly referenced and described hereinafter. The electrical power cable 10 is generally shown in FIG. 1, which illustrates one end 11 of the twin-axial cable electrically connected to an amplifier power supply 13 and the other end 12 electrically connected to a standard 110–120 AC volt outlet 14 operating at 60 Hz typically found in the United States of America.

FIG. 1 shows the power cable 10 essentially comprised of two identical bundles of insulated wires designated generally as 15 and 16. One of such generally shown bundles is electrically connected between the "hot" (H) terminal at the power supply end 11 and the corresponding "hot" (H) terminal of a standard three-prong plug (not shown) at the AC outlet end 12/14. The other bundle 16 is electrically connected between the "neutral" (N) terminal at the power supply end 11 and the corresponding "neutral" (N) terminal of a three-prong plug at the outlet end 12/14. Of course, the principles of the invention find ready application to European standards as well as to those of other counties. Two ground wires 17/18 and a drain wire 19 which also extend throughout the length of the twin-axial cable 10 are generally shown electrically connecting ground at the power supply end 11/13 to ground at the plug (not shown) at the AC outlet end 12/14. The two bundles 15/16, ground wires 17/18, and the drain wire 19 are surrounded by a foil shield 20 which is in turn surrounded by a flexible cable insulation jacket.

The exemplary embodiment of the invention described herein provides protection from EMI (electromagnetic interference) and RFI (radio frequency interference) while enabling instantaneous and uniform current transfer between a 60 Hz outlet and a power amplifier capable of drawing up to 20 amps and providing 1,000 watts rms per channel without appreciable phase delays for driving loudspeakers. The disclosed embodiment also presents a compact, flexible, and durable cable. In the frequent contortions to which power cables are often subjected, such as the situation in which a wall outlet is inconveniently located, the geometric internal structure of the cable is such that conductors, shields, drain and ground wires, and dielectrics are not dislocatable.

Figure 3:
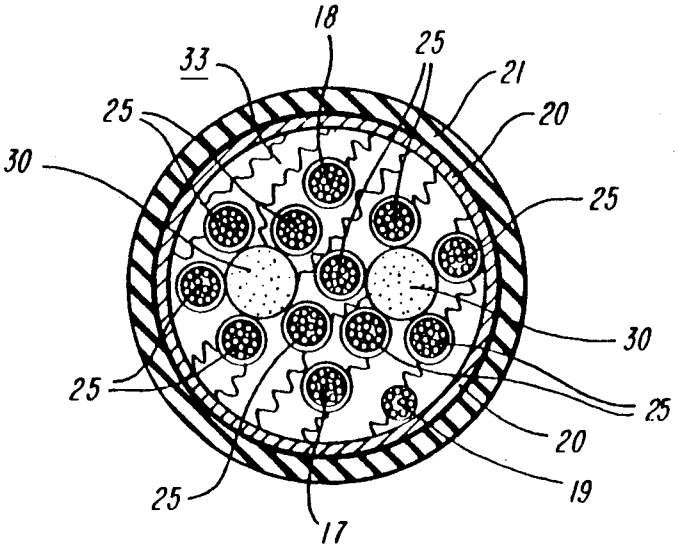
FIG. 3 is a cross-sectional view of the FIG. 2 power cable.
Figure 2:
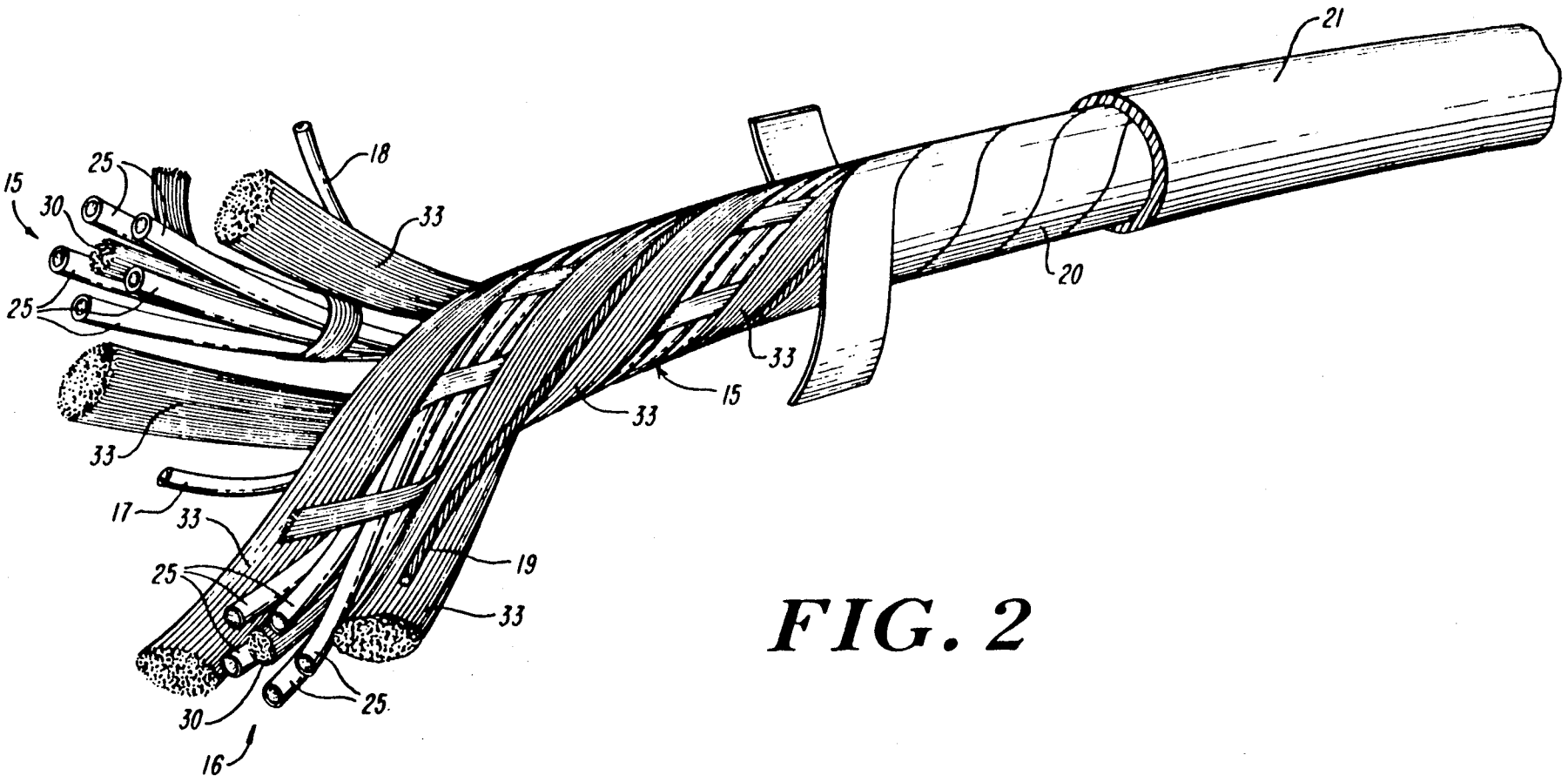
FIG. 2 is a partially exploded perspective view of one embodiment of a power cable of the present invention.

Each of the bundles 15/16 is preferably comprised of five insulated wire strands 25 symmetrically and helically wound around a nonconductive center 30, as shown in FIGS. 2 and 3. Solid conductors rather than the strands 25 could be employed as well without departing from the inventive concept. The wires are helically wrapped in the preferred embodiment to provide a compact yet flexible configuration that retains its mechanical integrity and therewith its electrical characteristics to be described notwithstanding any wear to which handling subjects the bundles, and at the same time allows for a compact and desirably symmetrical overall cable configuration. The nonconductive center 30 may be comprised of polyethylene or other plastic or other composition. It is important that the center be non-conductive, for if it were conductive, an undesirable field could be introduced therein by the surrounding conductors. The non-conductive center 30 cooperates to provide the remarkable sonic quality of the instant invention.

The preferred size or gauge of the insulated wire strands 25 is determined in accord with the present invention by ascertaining a radius measurement of the wire which is no greater than one half the skin depth of current at 60 Hz for the exemplary United States standard. In other words, the diameter is selected in accord with the invention such that current travels at the center of the wire with substantially the same phase delay as current travelling at the outer surface of the wire.

To determine this radius in accord with the present invention, the following relation, which relates skin depth, $\delta$, to the conductivity, $\sigma$, angular frequency, $\omega$, and magnetic permeability, $\mu$, is solved for a selected power cable conductive material, copper in the preferred embodiment, at a selected frequency, 60 hertz in the exemplary embodiment:

$$\delta = \sqrt{\frac{2}{\sigma\omega\mu}} \quad (1)$$

Using this value as an upper bound, the maximum current carrying capability of a power cable in accord with the present invention, $J_{MAX}$, is determined using the following relation, wherein "a" is the radius of the conductor, and "I" is the total current flowing through the conductor:

$$J_{MAX} = \frac{e^{\frac{a}{\delta}} I}{2\pi\delta[ae^{\frac{a}{\delta}} - \delta(e^{\frac{a}{\delta}} - 1)]} \quad (2)$$

In further accord with the present invention, the number of wires of the one or more wires of the bundle of wires of the power cable in accord with the invention is selected to be commensurate with the total intended current carrying capability, $J_{TOT}$ for an intended applications environment, according to the relation:

$$n = \frac{J_{TOT}}{J_{MAX}} \quad (3)$$

The above relations in accord with the invention may be iteratively solved to optimize gauge, current-carrying capabilities, skin depth, and mechanical features, and may be implemented manually or by computer. At any step, for a given combination of gauge, current carrying capabilities and skin depth, the following relation may be employed to discover the actual phase delays for that iteration:

$$J(r) = J_{MAX}e^{\frac{r-a}{\delta}} \quad (4)$$

An exemplary embodiment for the twin-axial bundles at 60 Hertz and 20 amperes comprises two bundles 15/16 containing five strands 25 each of 18 AWG wire twisted around a nonconductive center 30. Between the crevices formed by the bundles 15/16 are located two drain wires 17 and 18, which are also 18 AWG wire. The group of bundled conductors 15/16 and drain wires 17/18 are shown twisted in spiral manner about each other. A nonconductive material, such as polypropylene, is used for a filler 33. Polypropylene filler may also be used for the dielectric center 30 of the conductor bundles 15/16. A nonconductive drain wire 19 is placed over the filler 33 and in electrical contact with a foil shield 20 which can be made of aluminum or Mylar (Trademark for a polyester film manufactured by DuPont de Nemours, E.I. & Co.) copper, or other materials commonly used for shielding purposes. However, the foil shield of the mylar variety is preferable due to flexibility, ease of use, and the necessity for using a drain wire 19 in electrical contact therewith which contributes to the desired roundness of the cable shape. Using the drain wire 19 avoids the termination problems commonly associated with shields of the braided metal variety. The shielded cable is jacketed as shown at 21 as by being passed through an extruder. Any suitable flexible, durable, plastic cable jacket covering, such as polyvinylchloride (PVC), may be used.

While a preferred embodiment of the invention has been shown and described herein, it is to be understood by those skilled in the art that modifications may be made therein without departing from the scope and spirit of the invention.

What is claimed is:

1. A twin-axial power cable for transfer of current having uniform density free from phase delays, comprising:

first and second bundles each having a nonconductive element and at least one insulated electrically conductive wire of a predetermined gauge disposed around said nonconductive element;

said at least one insulated electrically conductive wire of each of said first and second bundles being equal to the other in total cross-sectional area. each at least one insulated electrically conductive wire of said first and second bundles having a radius no greater than one half the skin depth of current travelling through the cable at 60 Hz;

an insulated electrically conductive ground wire of predetermined gauge located along each of said at least one insulated electrically conductive wires of said first and second bundles;

a filler of nonconductive material located around said first and second bundles and said at least one insulated electrically conductive ground wire, said filler for pliably packing said bundles and said at least one insulated electrically conductive ground wire;

an electrically conductive foil shield surrounding said twin-axial bundles, said insulated electrically conductive ground wires, and said filler;

a non-insulated electrically conductive drain wire located within said surrounding foil shield and between said filler and said foil shield, said non-insulated electrically conductive drain wire being in electrical and mechanical contact with said electrically conductive foil shield; and a nonconductive flexible cable jacket tightly surrounding said foil shield.

2. The power cable of claim 1 wherein said electrically conductive wires of said first and second bundles are helically wrapped around a nonconductive center.

3. The power cable of claim 1 wherein each of said first and second bundles comprises five insulated wires of 18 AWG stranded conductors.

4. The power cable of claim 1 wherein each of said first and second bundles are comprised of five 18 AWG conductors and each of said ground wires are 18 AWG ground wires placed along said first and second bundles, and said bundles and ground wires are twisted spirally among themselves uniformly between one end of the cable to the other end of the cable.

5. The power cable of claim 1 wherein said ground wires are comprised of 18 AWG gauge stranded wire.

6. The power cable of claim 1 wherein said non-insulated electrically conductive drain wire is comprised of an 18 AWG gauge stranded wire.

7. The power cable of claim 1 wherein said nonconductive filler is polypropylene.

8. The power cable of claim 2 wherein said nonconductive center of each of said first and second bundles is polypropylene.

9. The power cable of claim 1 wherein said foil shield is comprised of aluminum on a film comprised of polyester.

10. The power cable of claim 1 wherein said foil shield contains copper.

11. The power cable of claim 1 wherein said cable jacket is comprised of polyvinyl chloride extruded around said foil-wrapped bundles, said ground wires, drain wire, and packing filler providing a generally round cross-section that is pliable, durable and capable of manipulation in all directions.

12. A twin-axial power cable for transfer of current having uniform density free from phase delays, comprising:

first and second bundles each having a nonconductive element and at least one insulated wire strand of a predetermined gauge disposed around said nonconductive element;

said at least one insulated wire strand of each of said first and second bundles being equal to the other in total cross-sectional area, each at least one strand of said first and second bundles having a radius no greater than one half the skin depth of current travelling through the cable at 60 Hz;

a ground wire of predetermined gauge located along each of said at least one insulated wire strand of said first and second bundles;

said first and second bundles of said at least one insulated wire strand and said ground wires twisted spirally about each other along the cable length to present a generally round cross-sectional shape and to minimize electromagnetic interference and inductance;

a filler of nonconductive material located around said first and second bundles and said ground wires, said filler for pliably packing said bundles and said ground wires;

a foil shield wrapped around said twin-axial bundles, ground wires, and filler;

a non-insulated drain wire located within said surrounding foil shield and between said filler and said foil shield, said drain wire being in electrical contact with said foil shield; and a nonconductive flexible cable jacket tightly surrounding said foil shield.

13. An audiophile power cable for transferring a maximum intended current having uniform density free from phase delays at a predetermined frequency, comprising:

a first bundle having a predetermined number of insulated wire strands each of a predetermined gauge symmetrically and helically wound in one layer around a nonconductive center, the number being determined to accommodate the maximum intended current such that the current carrying capability of each wire times the number of wires is no less than the maximum intended current, the predetermined gauge being determined such that the phase delay corresponding to that gauge is substantially equal to zero for the predetermined frequency;

a second bundle having a predetermined number of insulated wire strands each of a predetermined gauge symmetrically and helically wound in one layer around a nonconductive center, the number being determined to accommodate the maximum intended current such that the current carrying capability of each wire times the number of wires is no less than the maximum intended current, the predetermined gauge being determined such that the phase delay corresponding to that gauge is substantially equal to zero for the predetermined frequency;

said insulated wire strands of each of said first and second bundles being equal to the other in total cross-sectional area; and at least one ground wire of predetermined gauge located along each of said insulated wire strands of said first and second bundles.

* * * * *

UNITED STATES PATENT AND TRADEMARK OFFICE

CERTIFICATE OF CORRECTION

PATENT NO. : 5,110,999

DATED : May 5, 1992

INVENTOR(S) : Todd Barbera

It is certified that error appears in the above-indentified patent and that said Letters Patent is hereby corrected as shown below:

Column 6, line 55, "at 21 as" should read --at 21 such as--.

Signed and Sealed this

Seventeenth Day of January, 1995

*Attest:*

Bruce Lehman

BRUCE LEHMAN

*Attesting Officer*

*Commissioner of Patents and Trademarks*